US009387514B2

(12) United States Patent
Mosca et al.

(10) Patent No.: US 9,387,514 B2
(45) Date of Patent: Jul. 12, 2016

(54) LOW FREQUENCY ELECTRO ACOUSTIC TRANSDUCER AND METHOD OF GENERATING ACOUSTIC WAVES

(75) Inventors: Frederic Mosca, Marseilles (FR); Marcel Vial, Toulon (FR); Gilles Greninguey, Le Puy Ste Reparade (FR); Guillaume Matte, La Garde (FR)

(73) Assignee: IXBLUE, Marly le Roi (FR)

( * ) Notice: Subject to any disclaimer, the term of this patent is extended or adjusted under 35 U.S.C. 154(b) by 345 days.

(21) Appl. No.: 13/982,587

(22) PCT Filed: Jan. 31, 2012

(86) PCT No.: PCT/FR2012/050212

§ 371 (c)(1), (2), (4) Date: Jul. 30, 2013

(87) PCT Pub. No.: WO2012/104549

PCT Pub. Date: Aug. 9, 2012

(65) Prior Publication Data

US 2013/0315037 A1 Nov. 28, 2013

(30) Foreign Application Priority Data

Feb. 1, 2011 (FR) ..... 11 50771

(51) Int. Cl.

| | |
|---|---|
| ***H04R 17/00*** | (2006.01) |
| ***B06B 1/06*** | (2006.01) |
| ***H04R 1/40*** | (2006.01) |
| ***H04R 1/44*** | (2006.01) |

(52) U.S. Cl.

CPC ..... *B06B 1/0633* (2013.01); *B06B 1/0618* (2013.01); *H04R 1/403* (2013.01); *H04R 1/44* (2013.01); *H04R 17/00* (2013.01)

(58) Field of Classification Search

CPC ..... H04R 1/403; H04R 1/44; H04R 17/00; B60B 1/0633; B60B 1/0618

USPC ..... 367/159

See application file for complete search history.

(56) References Cited

U.S. PATENT DOCUMENTS

| | | | | |
|---|---|---|---|---|
| 5,363,345 | A * | 11/1994 | Boucher | G10K 11/205 310/322 |
| 5,483,502 | A * | 1/1996 | Scarpitta | G10K 13/00 310/334 |
| 5,579,287 | A | 11/1996 | Boucher et al. | |
| 5,694,374 | A * | 12/1997 | Ripoll | B06B 1/0618 310/337 |
| 2007/0080609 | A1 | 4/2007 | Johnson et al. | |
| 2011/0255375 | A1 | 10/2011 | Mosca et al. | |

FOREIGN PATENT DOCUMENTS

| | | | |
|---|---|---|---|
| EP | 0 684 084 | A1 | 11/1995 |
| FR | 2 940 579 | A1 | 6/2010 |

OTHER PUBLICATIONS

International Search Report, dated Nov. 28, 2012, from corresponding PCT application.

* cited by examiner

*Primary Examiner* — Mark Hellner

(74) *Attorney, Agent, or Firm* — Young & Thompson

(57) ABSTRACT

An electroacoustic transducer submersible in an immersion fluid (8) for underwater acoustic communications, includes two horns (3*a*, 3*b*), a counterweight (4), two electroacoustic motors (1*a*, 1*b*), aligned along an axis of symmetry (6), the opposite ends of the motors being respectively connected to a horn, the unit consisted by the electroacoustic motors, the counterweight and the horns being able to generate a longitudinal electroacoustic resonance mode. The transducer includes a rigid and hollow cylindrical part (5) extending around the counterweight, the cylindrical part having an axis merged with the symmetry axis of the transducer, the inside of the cylindrical part forming a fluid cavity able to be filled with the immersion fluid, the electroacoustic motors and the cylindrical part being so dimensioned that the fluid cavity forms an acoustic coupling between the longitudinal electroacoustic resonance mode and a circumferential resonance mode of the cylindrical part.

16 Claims, 1 Drawing Sheet

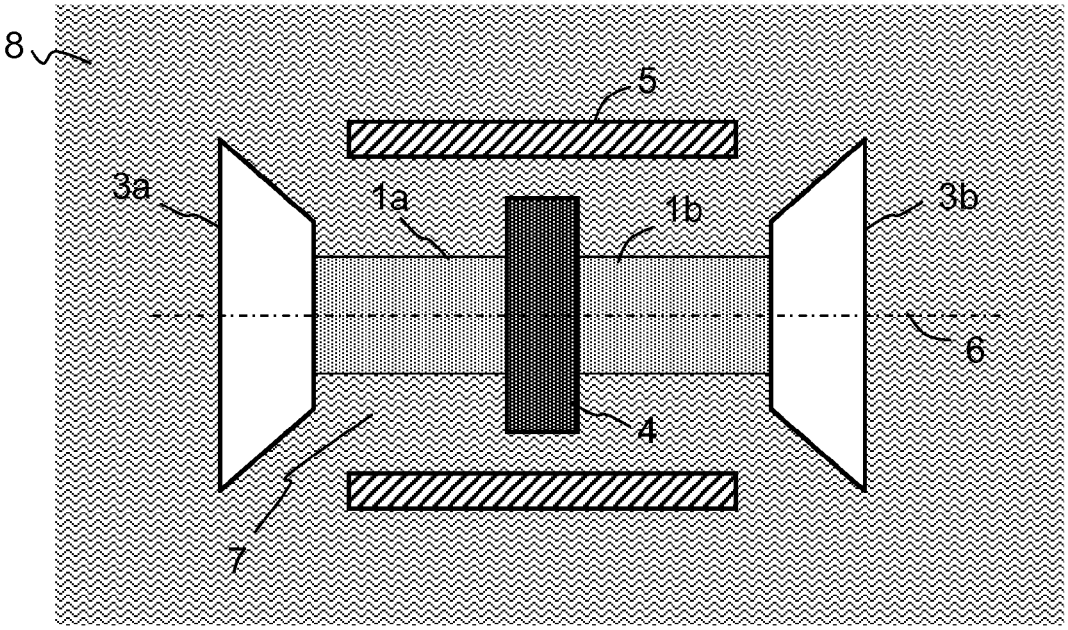
8
5
3a
1a
1b
3b
6
4
7

LOW FREQUENCY ELECTRO ACOUSTIC TRANSDUCER AND METHOD OF GENERATING ACOUSTIC WAVES

The present invention relates to an electro-acoustic transducer for underwater acoustic communications or for underwater acoustic tomography. More precisely, the invention relates to a submersible electroacoustic transducer operating in the low-frequency domain (lower than 1 kHz), compatible with great depths of immersion (higher than 3000 m) and having a long autonomy. The invention also relates to a method of generating low-frequency and wide band acoustic waves.

An electro-acoustic transducer is used for the transmission and/or the reception of acoustic pressure waves. In transmission mode, an acoustic transducer transforms an electric potential difference into an acoustic pressure wave, and the reverse in reception mode. A transducer has a frequency bandwidth and presents a so-called central frequency, which corresponds to the middle of the bandwidth.

The underwater acoustic communications over distances higher than about ten kilometers require the use of low-frequency acoustic sources (frequency lower than 1 kHz) to reach the objectives of long range and wideband (bandwidth higher than 10% of the central frequency) and to allow sufficient data rates.

Various types of low-frequency transducers are commonly used in the underwater acoustics:

- the sparkers are acoustic spark-gaps, the coding of the transmitted wave of which is not possible;
- the boomers generate acoustic waves by Foucault current in two parallel metal plates, but they do not allow a coded communication;
- the piezoelectric rings are systems consisted of one or several metal rings on the inner wall of which are radially arranged several piezoelectric motors. When the piezoelectric motors are excited, the rings are put in vibration. These rings thus act as horns or vibrating walls. However, the implementation of the piezoelectric-ring systems remains difficult and their repeatability is insufficient;
- the Janus-Helmholtz transducers are compatible with a coding but they suffer from limitations at low frequencies.

Hereinafter, reference is more particularly made to a transducer of the Janus-Helmholtz type. A Janus-Helmholtz transducer, also called double Tonpilz, is based on the use of a stack of piezoelectric components forming a piezoelectric motor. A Janus-Helmholtz transducer comprises two piezoacoustic motors aligned along a same axis and fixed on a central counterweight, each piezoacoustic motor being connected to a horn through a prestressing rod. The two horns are thus located at the opposite ends on the axis of the device and are symmetrical with respect to a plane transverse to the axis. A Janus-Helmholtz transducer generally comprises a non-resonating, rigid, cylindrical enclosure, which delimitates a fluid cavity located between the inner wall of the enclosure and the rear faces of the horns. A Janus-Helmholtz transducer allows working at lower acoustic frequencies (from 150 Hz to 20 kHz) than a transducer of the Tonpilz type (frequency higher than 1 kHz). A Janus-Helmholtz transducer generates a longitudinal acoustic resonance mode in direction of transmission located along the transducer axis. Hereinafter, this resonance mode will be referred to as the longitudinal resonance mode. However, the Janus-Helmholtz transducers suffer from limitations at low frequencies (<1 kHz). In particular, the resonance frequency being reversely proportional to the volume of the cavity, a low-frequency Janus-Helmholtz transducer imposes volume constraints.

A piezoacoustic resonator is generally placed in a waterproof protection enclosure. The outer face of the horn is in direct contact with the immersion medium or placed behind an acoustically transparent diaphragm. The inner cavity of the enclosure is filled with air or with a fluid chosen to have a good acoustic impedance without loss, i.e. without rupture of impedance with water. The fluid used is generally an oil. When the cavity is filled with air, the acoustic coupling between the transducer and the immersion medium is made via the outer face of the horn. When the cavity is filled with oil, the acoustic coupling between the transducer and the immersion medium is made via of the horn, through the oil and the enclosure. The immersed transducer transforms the vibration wave of the resonator into an acoustic pressure wave that propagates in the immersion medium.

It is known that the performance of the piezoelectric ceramics vary significantly in the case of use in deep immersion, because the hydrostatic pressure forces increase linearly with the depth of immersion.

There exist electroacoustic transducers comprising a waterproof enclosure filed with gas, but the enclosure must be solid enough to resist to the pressures of immersion in the liquid, which significantly increases the weight of the transducer when the depth of immersion is great.

There exist electroacoustic transducers comprising a pneumatic compensation system for compensating for the efforts of the hydrostatic pressure onto the enclosure and increasing the resistance to the external pressure in deep immersion. Such complex pneumatic compensation systems are however limited to depths of immersion lower than 3000 m.

In the electroacoustic transducers comprising an enclosure, it is generally searched to attenuate the transmission of acoustic waves through the enclosure, this enclosure transmission being at the origin of losses by radiation in undesirable directions of transmission and reception. There exist various devices for decoupling between the enclosure et the piezoelectric stack, based in particular on the use of means for absorption or diffraction of the acoustic waves in directions transverse to the transducer axis.

On the other hand, in order to reduce the resonance frequency of an acoustic transducer, a known solution consists in placing compliant tubes filled with gas in the resonant cavity. Such a transducer has then a resonance frequency comprised between 500 and 1000 Hz. However, the compliant tubes being subjected to the hydrostatic pressure of the immersion medium, they undergo a crushing at high pressures, which limits the depth of immersion of the transducer to less than 1000 m.

One object of the invention is to provide an autonomous underwater acoustic communication system for transmitting acoustic waves at great depths of immersion and at low frequencies. Another object of the invention is to propose a method for generating low-frequency and wide band acoustic waves.

The technical problem is to reduce the resonance frequency of a submersible electroacoustic transducer of the Janus-Helmholtz type without increasing the size and the weight of the transducer in order to ensure an electroacoustic efficiency and a long autonomy at great depths of immersion.

The present invention has for object to remedy the drawbacks of the prior devices and more particularly relates to an electroacoustic transducer submersible in an immersion fluid for underwater acoustic communications, said transducer comprising two horns, a counterweight, two electroacoustic motors, placed on either side of the counterweight, said motors being aligned along an axis of symmetry, the opposite ends of said motors being respectively connected to a horn, the unit consisted by said electroacoustic motors, said counterweight and said horns being able to generate a longitudinal electroacoustic resonance mode. According to the invention, said transducer comprises a rigid and hollow cylindrical part extending around said counterweight, said cylindrical part having an axis merged with the symmetry axis of the transducer, the inside of said cylindrical part forming a fluid cavity able to be filled with said immersion fluid, said electroacoustic motors and said cylindrical part being so dimensioned that said fluid cavity forms an acoustic coupling between said longitudinal electroacoustic resonance mode of said transducer and a circumferential resonance mode of said cylindrical part when said fluid cavity is filled with said immersion fluid.

According to a particular embodiment of the invention, said cylindrical part is fixed to said counterweight by suspension means able to acoustically decouple said cylindrical part from said counterweight.

According to a preferred embodiment of the invention, said cylindrical part is made of a metal material or a composite material able to produce an acoustic vibration mode of the circumferential type.

According to an aspect of the invention, said transducer is able to provide a source of acoustic transmission of acoustic frequency lower than 10000 Hz and having a bandwidth higher than 10% of the central acoustic frequency. According to a preferred embodiment of the invention, said transducer is able to provide a source of acoustic transmission of acoustic frequency lower than 1000 Hz and having a bandwidth higher than 10% of the central acoustic frequency.

According to particular aspects of the invention:

said cylindrical part has an annular section;

the walls of said cylindrical part are solid;

said fluid cavity if filled with water;

the frequency difference between the longitudinal resonance mode of the piezoelectric stack and the circumferential mode of the cylindrical part is lower than or equal to about 10% of the central frequency of the transducer.

The invention also relates to a method of transmission of flow-frequency acoustic waves in an immersion fluid, comprising the steps of:

generating acoustic waves in an immersion fluid according to a longitudinal resonance mode of a resonator comprising two piezoelectric stacks arranged on either side of a counterweight and aligned along an axis, the opposite ends of said stacks being respectively connected to two horns;

coupling said longitudinal resonance via a fluid cavity open out to said immersion fluid to a circumferential acoustic resonance mode of a cylindrical part coaxial to said stacks and surrounding said counterweight, said cylindrical part delimiting said fluid cavity.

The invention will find a particularly advantageous application in the underwater acoustic communication systems. Another application of the transducer of the invention relates to the underwater acoustic tomography.

The present invention also relates to the characteristics that will become evident from the following description and that will have to be considered either alone or in any technically possible combination thereof.

This description, which is given by way of non-limitative example, will allow a better understanding of how the invention can be implemented, with reference to the appended drawings in which:

FIG. 1 shows a sectional view of an electroacoustic transducer according to an embodiment of the invention.

The transducer of FIG. 1 is an electroacoustic transducer allowing underwater acoustic communications by resonant coupling between a piezoelectric stack and a cylindrical part of annular section whose axis is merged with the piezoelectric stack. The cylindrical part is of circumferential resonance, such resonance mode being also called respiration mode.

More precisely, FIG. 1 schematically shows a sectional view of a transducer comprising two piezoelectric motors (1*a*, 1*b*) aligned along a longitudinal axis (6). The piezoelectric motors are fixed on either side of a central counterweight (4). The opposite ends of the two motors (1*a*, 1*b*) are respectively fixed to a horn (3*a*, 3*b*). The unit consisted by the piezoelectric motors (1*a*, 1*b*), the counterweight (4) and the horns (3*a*, 3*b*) is held in a prestressed state by so-called prestressing rods, which may be either external or internal to the axial pillar.

The transducer further includes a cylindrical part (5), preferably of annular section, hollow and coaxial to the longitudinal axis (6). The cylindrical part (5) is arranged around the counterweight (4) and preferably centered on the plane of symmetry of the transducer. In the scheme of FIG. 1, the length of the cylindrical part (5) is lower than the total length of the piezoelectric stacks and of the counterweight, or also lower than the distance separating the two horns (3*a*, 3*b*). The outer diameter of the cylindrical part (5) is substantially equal to the outer diameter of the horns. The thickness of the cylindrical part is typically of the order of the centimeter. The walls of the cylindrical part are preferably solid, the cylindrical part (5) including two openings at its two opposite ends.

The dimensions of the hollow cylindrical part (5) are such that the latter delimits an inner fluid cavity (7). The fluid cavity (7) is open out to the outside by the openings located at its two ends, so that when the transducer is immersed, the volume of the cavity (7) is filled with the immersion fluid (8), for example sea water. Therefore, the components of the transducer are permanently in equipressure with respect to the hydrostatic pressure of the immersion medium, whatever is the depth of immersion. The structure of the transducer allows it to support high hydrostatic pressures associated with the great depths of immersion, without requiring a pneumatic compensation system.

The physical parameters of the cylindrical part (5) are determined in such a manner that the latter is able to generate a circumferential acoustic resonance mode. For a ring part, the first circumferential resonance mode is determined by the following formula:

$$F_r=1/(2*\pi*\sqrt{(Sr*\rho*a^2)})$$

where $F_r$ represents the resonance frequency, $S_r$, the radial flexibility, ρ, the density of the material, and a the mean radius. The application of this formula typically gives, for a disk of aluminum of 1 m in diameter, a resonance frequency close to 1500 Hz. In the transducer of the invention, the excitation of the circumferential resonance mode of the cylindrical part (5) is made by the electric excitation of a piezoelectric resonator (1*a*, 1*b*) via an acoustic coupling of the fluid cavity (7).

According to a preferred embodiment, the electroacoustic transducer constitutes a source of wideband, low-frequency (<1000 Hz) acoustic transmission, based on the coupling of two resonators. The first resonator is the piezoelectric resonator of the mass-spring type, whose fundamental mode is longitudinal, referred to as dilatation-compression. The second resonator is a resonator formed by the cylindrical part (5) having a circumferential or radial resonance mode. The longitudinal resonance mode and the circumferential resonance mode are coupled via the fluid cavity (7) consisted of the sea water of the surrounding medium. The coupling is made via the fluid cavity (7) contained within the cylindrical part (5). The longitudinal resonance mode of the piezoelectric stack is dimensioned in such a manner to be close in frequency to the circumferential mode of the annular part so as to allow an efficient coupling between the two resonances.

The radial part may be metallic or made of a composite material (such as carbon/epoxy fibers) and is held integral with the piezoelectric stack by the central counterweight. The radial part is linked to the central counterweight by suspension means forming an acoustic decoupler. According to a preferred embodiment, the suspension means are formed by suspension blocks (or silent bloc), for example in the form of rubber washers. The suspension means are not shown in FIG. 1, in order to illustrate the acoustic decoupling between the counterweight (4) and the cylindrical part (5). Moreover, the suspension means are not waterproof and do not form an obstacle to the open fluid cavity.

The mechanical structure of the transducer allows the use thereof in great depths of immersion (higher than 3000 m). Moreover, the transducer includes no inner fluid part filled with air or oil. The transducer of the invention has thus a great robustness.

The invention claimed is:

1. An electroacoustic transducer submersible in an immersion fluid (8) for underwater acoustic communications, said transducer comprising:

two horns (3*a*, 3*b*), a counterweight (4), two electroacoustic motors (1*a*, 1*b*), placed on either side of the counterweight (4), said motors (1*a*, 1*b*) being aligned along a symmetry axis (6), the opposite ends of said motors (1*a*, 1*b*) being respectively connected to a horn (3*a*, 3*b*), the unit consisted by said electroacoustic motors (1*a*, 1*b*), said counterweight (4) and said horns (3*a*, 3*b*) being able to generate a longitudinal electroacoustic resonance mode, characterized in that said transducer comprises:

a rigid and hollow cylindrical part (5) extending around said counterweight (4), said cylindrical part (5) having an axis merged with the symmetry axis (6) of the transducer, the inside of said cylindrical part (5) forming a fluid cavity (7) able to be filled with said immersion fluid (8), said electroacoustic motors and said cylindrical part (5) being so dimensioned that said fluid cavity (7) forms an acoustic coupling between said longitudinal electroacoustic resonance mode of said transducer and a circumferential resonance mode of said cylindrical part (5) when said fluid cavity (7) is filled with said immersion fluid (8).

2. The electroacoustic transducer according to claim 1, characterized in that said cylindrical part (5) is fixed to said counterweight (4) by suspension means able to acoustically decouple said cylindrical part (5) from said counterweight (4).

3. The electroacoustic transducer according to claim 1, characterized in that said cylindrical part (5) is made of a metal material or a composite material able to produce an acoustic vibration mode of the circumferential type.

4. The electroacoustic transducer according to claim 1, characterized in that said cylindrical part (5) has an annular section.

5. The electroacoustic transducer according to claim 1, characterized in that the walls of said cylindrical part (5) are solid.

6. The electroacoustic transducer according to claim 1, characterized in that said transducer is able to provide a source of acoustic transmission of acoustic frequency lower than 10000 Hz and having a bandwidth higher than 10% of the central acoustic frequency.

7. The electroacoustic transducer according to claim 6, characterized in that said transducer is able to provide a source of acoustic transmission of acoustic frequency lower than 1000 Hz and having a bandwidth higher than 10% of the central acoustic frequency.

8. The electroacoustic transducer according to claim 1, characterized in that said fluid cavity (7) if filled with water.

9. The electroacoustic transducer according to claim 1, characterized in that the frequency difference between the longitudinal resonance mode of the piezoelectric stack and the circumferential mode of the cylindrical part (5) is lower than or equal to about 10% of the central frequency of the transducer.

10. A method of transmission of low-frequency acoustic waves in an immersion fluid, comprising the steps of:

generating acoustic waves in an immersion fluid (8) according to a longitudinal resonance mode of a resonator comprising two piezoelectric stacks (1*a*, 1*b*) arranged on either side of a counterweight (4) and aligned along an axis (6), the opposite ends of said stacks being respectively connected to two horns (3*a*, 3*b*);

coupling said longitudinal resonance via a fluid cavity (7) open out to said immersion fluid (8) to a circumferential acoustic resonance mode of a cylindrical part (5) coaxial to said stacks (1*a*, 1*b*) and surrounding said counterweight (4), said cylindrical part (5) delimiting said fluid cavity (7).

11. The electroacoustic transducer according to claim 2, characterized in that said cylindrical part (5) is made of a metal material or a composite material able to produce an acoustic vibration mode of the circumferential type.

12. The electroacoustic transducer according to claim 2, characterized in that said cylindrical part (5) has an annular section.

13. The electroacoustic transducer according to claim 2, characterized in that the walls of said cylindrical part (5) are solid.

14. The electroacoustic transducer according to claim 2, characterized in that said transducer is able to provide a source of acoustic transmission of acoustic frequency lower than 10000 Hz and having a bandwidth higher than 10% of the central acoustic frequency.

15. The electroacoustic transducer according to claim 2, characterized in that said fluid cavity (7) if filled with water.

16. The electroacoustic transducer according to claim 2, characterized in that the frequency difference between the longitudinal resonance mode of the piezoelectric stack and the circumferential mode of the cylindrical part (5) is lower than or equal to about 10% of the central frequency of the transducer.

* * * * *